United States Patent [19]

Jiruse et al.

[11] 4,052,055

[45] Oct. 4, 1977

[54] ARRANGEMENT FOR DRIVING A ROCKING INITIAL GRIPPER

[75] Inventors: Jaroslav Jiruse, Blansko; Josef Rozsypal, Adamov, both of Czechoslovakia

[73] Assignee: Adamovske strojirny, narodni podnik, Adamov, Czechoslovakia

[21] Appl. No.: 686,464

[22] Filed: May 14, 1976

[30] Foreign Application Priority Data

May 29, 1975 Czechoslovakia ..... 3770/75

[51] Int. Cl.[2] ..... B41F 1/28; B65H 29/08

[52] U.S. Cl. ..... 271/268; 101/232; 101/409; 271/277

[58] Field of Search ..... 101/408–411, 101/232; 271/268, 277

[56] References Cited

U.S. PATENT DOCUMENTS

| | | | |
|---|---|---|---|
| 2,056,922 | 10/1936 | Gegenheimer | 101/410 |
| 2,104,720 | 1/1938 | Baldwin | 271/268 |
| 2,776,136 | 1/1967 | Dietrich | 271/268 |
| 2,926,909 | 3/1960 | Jantzen | 271/268 |
| 3,151,552 | 10/1964 | Peyrebrune | 101/409 |
| 3,221,652 | 12/1965 | Mestre | 101/409 X |
| 3,257,109 | 6/1966 | Singh | 271/268 |
| 3,833,213 | 9/1974 | Smith | 271/268 X |
| 3,841,626 | 10/1974 | Weisgerber | 271/268 |
| 3,899,970 | 8/1975 | Jurny et al. | 101/409 X |

*Primary Examiner*—Russell R. Kinsey
*Assistant Examiner*—Paul J. Hirsch
*Attorney, Agent, or Firm*—Burgess, Ryan and Wayne

[57] ABSTRACT

The drive of a rocking initial gripper of a sheet printing machine is derived from the shaft of the impression cylinder by a control cam by way of a control roller and a control lever fixed directly on the shaft of the rocking initial gripper without intermediate elements.

3 Claims, 2 Drawing Figures

ARRANGEMENT FOR DRIVING A ROCKING INITIAL GRIPPER

BACKGROUND OF THE INVENTION

This invention relates to an arrangement for driving a rocking gripper particularly for sheet printing machines.

Arrangements for driving a rocking initial gripper have to impart to this gripper an operating motion consisting of three parts: (*a*) a continuous starting from a first rest position to a uniform movement at a speed coincident with the circumferential speed of the impression cylinder, (*b*) a continuous retardation up to the second rest position, (*c*) a continuous starting and retardation during return to the first rest position. In the first rest position the chucks of the initial gripper seize a previously lined up sheet and transmit it at a synchronous speed of the initial gripper and the impression cylinder to the chucks of the impression cylinder.

One of actually known arrangements for driving a rocking initial gripper is accomplished by application of a toothed segment fixed on the shaft of the initial gripper, this toothed segment meshing with a second toothed segment provided with two rollers rolling along a couple of cams.

A drawback of this arrangement is that the mutually meshing toothed segments do not secure an accuracy and uniformity of movement of the rocking initial gripper, required for maintaining a register in printing.

Another known drive of a rocking initial gripper uses for its working movement again toothed segments with the difference that the shaft of the initial gripper is supported on eccentrics, enabling an accomplishment of the movement from the second rest position to the first one along a different track.

A drawback of this arrangement is as in the earlier mentioned arrangement that it does not secure the accuracy and uniformity of movement, required for maintaining a register in printing.

A further known driving arrangement of a rocking initial gripper derives it working movement from a couple of cams, with rollers supported on a two arm lever bearing against their surfaces, the rocking motion of said lever transmitted by a rod to an arm of the initial gripper.

A drawback of this arrangement is that the necessary clearances in the joints of arms and rods cause an inaccuracy of the movement of the rocking initial gripper and thus also an inaccuracy of the maintenance of a register in printing.

SUMMARY OF THE INVENTION

It is an object of this invention to provide a simple driving arrangement of a rocking initial gripper without unwelcomed intermediate elements and to secure the required stability of the rocking initial gripper. The main feature of the arrangement according to this invention consists in that on the shaft of the rocking initial gripper a control lever with a control roller is fixed, this roller rolling along a control cam and furthermore a rocking lever is supported on the shaft of the rocking initial gripper, supporting a supporting roller, which is rolling along a supporting cam. The control cam and the supporting cam are fixed on a flange fixed in turn on one end of the driving shaft of the impression cylinder. The shaft of the rocking initial gripper is rotatably supported in a bracket fixed on the side wall of the printing machine. A recess is provided on the end of the control lever, where a compression spring with a bearing plate is supported with one end, an adjusting screw adjustably supported on the control lever acting on this spring, the other end of the spring being supported in a recess of the rocking lever.

An advantage of this arrangement is that the working motion of the rocking initial gripper is derived from a control cam by way of a control roller and a control lever fixed directly on the shaft of the rocking initial gripper without unwelcomed intermediate elements, securely thereby the accuracy of operation of the rocking initial gripper.

A further advantage of this arrangement is that the rocking lever is urged away from the control lever by a compression spring serving simultaneously for delimitation of manufacturing differences of parts of the mechanism and for securing the stability of the rocking initial gripper, the force of which compensate spring being adjustable.

Another advantage of this arrangement is, that the end of the shaft of the rocking initial gripper is rotatably supported in a bracket fixed on the side wall of the printing machine, so that no deflection of this shaft is experienced and thus also no unwelcomed oscillations thereof.

A still further advantage of this arrangement is that the control cam controls the acceleration, for the synchronous speed, the retarding and for the rest positions of the rocking initial gripper without additional elements, whereby the whole arrangement is simple, not difficult to manufacture, securing a reliability of operation and without liability to failures.

DESCRIPTION OF DRAWINGS

One of possible solutions of the arrangement according to this invention is schematically shown in the attached drawings, where.

DESCRIPTION OF PREFERRED EMBODIMENT

Figure 1:
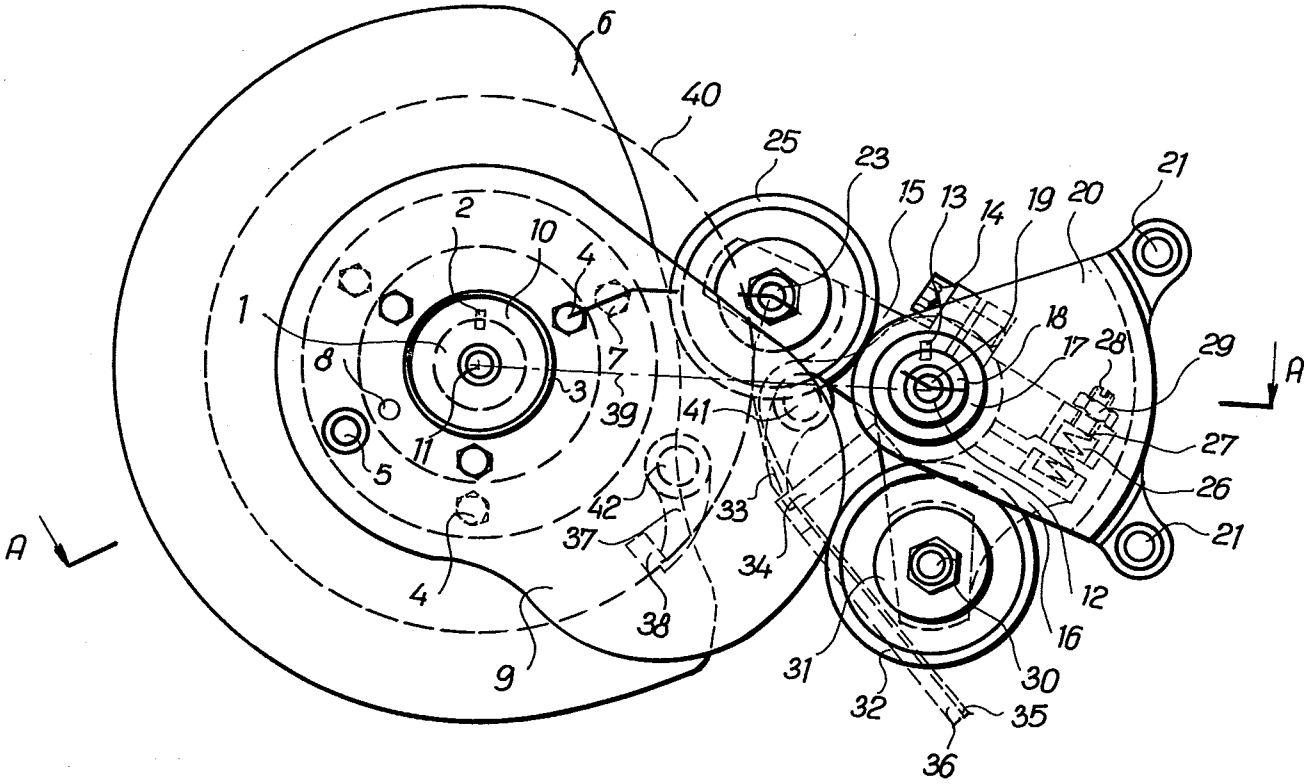
FIG. 1 is an elevation of the drive of a rocking initial gripper and FIG. 2 a sectional view thereof along a plane indicated in FIG. 1 by A—A.
Figure 2:
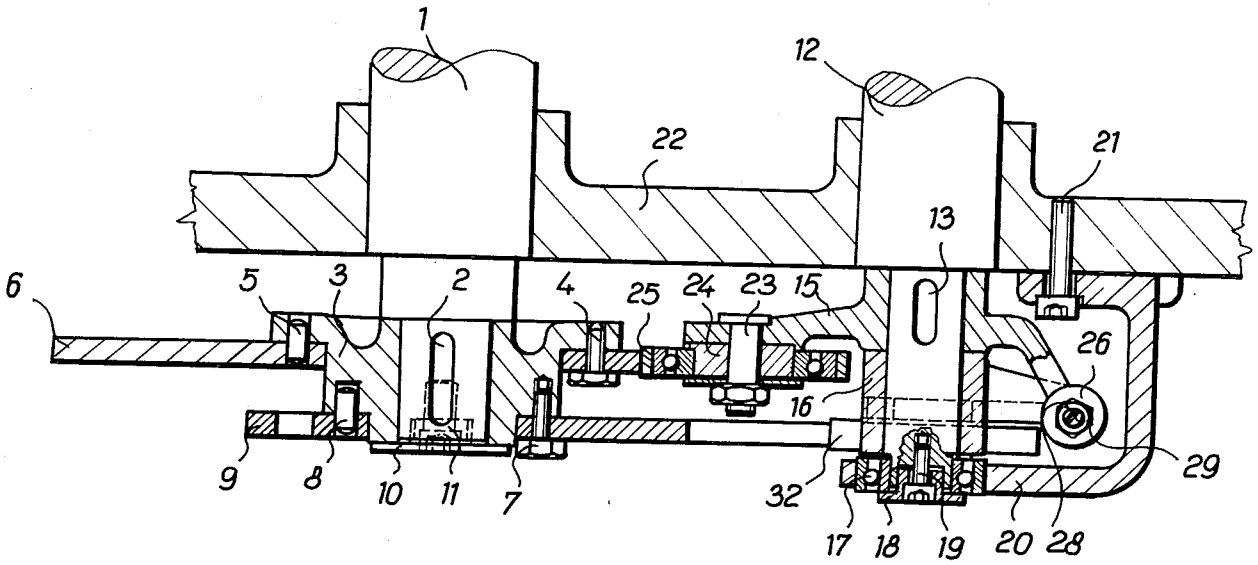

The arrangement according to this invention comprises a driving shaft 1 of an impression cylinder 40, on one end of which a flange 3 is fixed by a feather key. On this flange 3 a control cam 6 is fixed by means of a screw 4 and a bolt 5 and a supporting cam 9 is fixed by means of a fastening screw 7 and a safety bolt 8. The flange 3 is secured on the driving shaft 1 of the impression cylinder 40 by a bearing plate 10 and a fastening screw 11. A control lever 15 is fixed on the shaft 12 of the rocking initial gripper by means of a feather key 13 and a safety screw 14 and a rocking lever 16 is supported on this shaft 12. A bracket 20 is fixed on the side wall 22 of the printing machine by connecting screws 21. A bearing 17 supporting one end of the shaft 12 of the rocking initial gripper is provided in the bracket 20. The other part of bearing 17 is secured on shaft 12 of the rocking initial gripper by a bearing plate 18 and a safety screw 19. The driving shaft 1 of the impression cylinder 40 and the shaft 12 of the rocking initial gripper are supported by the side wall 22 of the printing machine. A connecting piece 24 is fixed by a connecting bolt 25 on one end of the control lever 15, a control roller 25 rotatably supported on this connecting piece 24. A recess is provided on the other end of the control lever 15 housing one end of a compression spring 26 with a bearing plate 27, an adjusting screw 26 provided with a nut 29 bearing against this plate 27. The compression spring 26 rests with its other end against a recess on one end of the rocking lever 16, on which a centering insert 31 with a supporting roller 32 is supported by a bolt 30. Chucks 33 of the rocking initial gripper, bearing with their working surfaces against a stop strip 34 are situated on a chuck shaft 41. Chucks 37 of the impression cylinder 40 are provided on a chuck shaft 42 of the impression cyclinder 40, resting with their operating surfaces against stops 38. The sheet 35 is conveyed to the first chucks 33 of the rocking initial gripper on a feeding table 36. A connecting axis 39 is indicated between the center of the driving shaft 1 of the impression cylinder 40 and between the center of shaft 12 of the rocking initial gripper.

The working cycle of this arrangement proceeds so that chucks 33 of the rocking initial gripper seize a sheet 35 aligned on the feeding table 36. At the moment the chucks 33 of the rocking initial gripper seize the sheet 35 the chuck shaft 41 of the rocking initial gripper is at rest. This first rest position of the chuck shaft 41 of the rocking initial gripper is secured by the control roller 25 rolling along the concentric part of the control cam 6. After termination of the first rest position an accelerated motion of the chuck shaft 41 of the rocking initial gripper takes place up to a speed coincident with the circumferential speed of the impression cylinder 40, whereby the sheet 35 is passed over to chucks 37 of the pressure cylinder 40. This passing over of sheet 35 is accomplished in the plane of the connecting axis 39 connecting the center of the driving shaft 1 of the impression cylinder 40 with the center of shaft 12 of the rocking initial gripper. The chuck shaft 41 of the rocking initial gripper retards thereafter its movement up to complete rest i.e. up to its second rest position. From this second rest position a movement of the chuck shaft 41 of the rocking initial gripper, again takes place up to the first rest position, where a further sheet 35 is seized by the chucks 33 of the rocking initial gripper and the whole cycle is repeating. The whole cycle composed of the first rest position, the acceleration a speed coincident with the circumferential speed of the impression cylinder 40, the second rest position and return movement to the first rest position is in this whole course determined by the shape of the control cam 6. The pressure of the control roller 25 on the control cam 6 and the pressure of the supporting roller 32 on the supporting cam is adjustable by the adjusting screw 28 acting on the compression spring 26.

We claim:

1. An arrangement for driving and controlling the periodic varying motion of a rocking initial gripper relative to the rotational speed of an impression cylinder within a sheet printing machine, where the sheets are fed into the machine for printing by means of chucks of a rocking initial gripper, comprising a driving shaft for the impression cylinder and a shaft for supporting the rocking initial gripper, a control roller, a control lever supporting the control roller fixed on the shaft of the rocking initial gripper, a control cam and a supporting cam fixed by means of a flange on the shaft of the impression cylinder, a supporting roller, a rocking lever supporting the supporting roller supported additionally on the shaft of the rocking initial gripper, the control roller bearing against the control cam and the supporting roller bearing against said supporting cam, the supporting roller maintaining the control roller against said control cam.

2. The arrangement as in claim 1, wherein said printing machine has a side wall, comprising a bracket fixed on the side wall of the printing machine, the shaft of the rocking initial gripper being rotatably supported by said bracket.

3. The arrangement as in claim 1, wherein the control lever is provided with a recess at the end thereof remote from the control roller, the rocking lever provided also having a recess, further comprising a compression spring supported by the ends thereof in said recesses, a bearing plate under one end of said spring, and an adjusting screw in the lever acting on said bearing plate for adjusting the force of said spring.

* * * * *